US009149816B2

(12) United States Patent
Zhou et al.

(10) Patent No.: US 9,149,816 B2
(45) Date of Patent: Oct. 6, 2015

(54) POINT TOUCH SWITCHING MECHANISM

(75) Inventors: Huasong Zhou, Xiamen (CN); Zhongcheng Jin, Xiamen (CN); Jianmin Chen, Xiamen (CN); Bin Chen, Xiamen (CN)

(73) Assignees: XIAMEN SOLEX HIGH-TECH INDUSTRIES CO., LTD., Xiamen (CN); Huasong Zhou, Xiamen (CN)

( * ) Notice: Subject to any disclaimer, the term of this patent is extended or adjusted under 35 U.S.C. 154(b) by 63 days.

(21) Appl. No.: 14/004,578

(22) PCT Filed: Mar. 5, 2012

(86) PCT No.: PCT/CN2012/071924

§ 371 (c)(1), (2), (4) Date: Sep. 11, 2013

(87) PCT Pub. No.: WO2012/122905

PCT Pub. Date: Sep. 20, 2012

(65) Prior Publication Data

US 2014/0001289 A1 Jan. 2, 2014

(30) Foreign Application Priority Data

Mar. 11, 2011 (CN) ..... 2011 1 0060540
Mar. 11, 2011 (CN) ..... 2011 2 0064573 U

(51) Int. Cl.
*B05B 1/18* (2006.01)
*B05B 1/16* (2006.01)
*B05B 15/06* (2006.01)

(52) U.S. Cl.
CPC ..... *B05B 1/185* (2013.01); *B05B 1/1663* (2013.01); *B05B 1/18* (2013.01); *B05B 15/061* (2013.01); *B05B 15/067* (2013.01)

(58) Field of Classification Search
None
See application file for complete search history.

(56) References Cited

U.S. PATENT DOCUMENTS

| | | | | |
|---|---|---|---|---|
| 2007/0113332 | A1 | 5/2007 | Ho | |
| 2010/0133364 | A1 * | 6/2010 | Chen et al. | 239/587.5 |
| 2011/0186653 | A1 * | 8/2011 | Cai et al. | 239/548 |

FOREIGN PATENT DOCUMENTS

| | | | |
|---|---|---|---|
| CN | 1236675 | A | 12/1999 |
| CN | 101428258 | A | 5/2009 |
| CN | 201505583 | U | 6/2010 |
| CN | 201625597 | U | 11/2010 |
| CN | 201659037U | U | 12/2010 |
| CN | 201969618 | U | 9/2011 |
| WO | WO-2005097346 | A1 | 10/2005 |

* cited by examiner

*Primary Examiner* — Len Tran
*Assistant Examiner* — Adam J Rogers
(74) *Attorney, Agent, or Firm* — Rabin & Berdo, P.C.

(57) ABSTRACT

A point touch switching mechanism has a ball head component, a water separation unit, a switching unit, and a swinging block. The water separation unit can swing with respect to the ball head. The switching unit comprises a slide base connected to the water separation unit and a water separation disk fixedly connected to the slide base, so that the water separation disk can rotate forward when sliding with respect to the water separation unit, and water separation switching can be implemented when the water separation disk rotates with respect to the water separation unit. The swinging block can be connected to the water separation unit in a sliding manner, and the sliding of the swinging block and of the slide base form a connection, so that the water separation unit can drive the swinging block and drive the slide base to slide with respect to the water separation unit.

12 Claims, 7 Drawing Sheets

POINT TOUCH SWITCHING MECHANISM

FIELD OF THE INVENTION

The present invention relates to a point touch switching mechanism.

BACKGROUND OF THE INVENTION

Existing switching mechanism is usually applied with sliding switch or rotating switching, as it needs to slide or rotate the switching mechanism to realize switch, it is inconvenient to operate, especially when the switch mechanism is placed high. In Chinese patent database, it is published with a single point touch shower of utility model in Dec. 1, 2010, the application is the same application of the present invention; the single point touch shower includes a fixation unit, an outlet and a switching mechanism. The fixation unit is disposed with an inlet waterway to connect to the water resource. The outlet is connected to the fixation unit in swinging way, and is disposed with several outlet functions. the switching mechanism includes a first ratchet, a stop catch and a driving mechanism, the first ratchet is connected to the outlet in freely rotating way, the stop catch is connected to the first ratchet and the outlet to limit the first ratchet to rotate backwards, the driving mechanism is connected to the first ratchet and the fixation unit to change the relatively swinging between the outlet and the fixation unit to the relatively rotating between the first ratchet and the outlet, the switch of the several outlet functions is realized by the relatively rotating of the first ratchet and the outlet. The structure of the existing technology is complex, it needs improvement.

SUMMARY OF THE INVENTION

The present invention is provided with a point touch switching mechanism, which overcomes the disadvantage of the single point touch shower of the background technology that the structure is complex.

The technical proposal of the present invention to solve the technical problem is as below:

A point touch switching mechanism, wherein comprises:

A ball head component (10);

A water separation unit (12), which is connected to the ball head component (10), so that the water separation unit (12) can swing with respect to the ball head component (10);

A switching unit, which comprises a slide base (14) connected to the water separation unit (12) and a water separation disk (16) fixed to the slide base (14), so that the water separation disk (16) can rotate forward itself when sliding forward or backward with respect to the water separation unit (12), and the water separation switching is implemented when the water separation disk (16) rotates with respect to the water separation unit (12); and A swinging block (18), which is connected to the water separation unit (12) in sliding way, the sliding of the swinging block (18) and the sliding of the slide base (14) are formed linking connection relationship, so that when swinging with respect to the ball head component (10), the water separation unit (12) can drive the swinging block (18) to slide with respect to the water separation unit (12) and drive the slide base (14) to slide with respect to the water separation unit (12).

In another preferred embodiment, the sliding line of the slide base (14) and the water separation unit (12) is a line (X), the sliding line of the swinging block (18) and the water separation unit (12) is perpendicular to line (X).

In another preferred embodiment, the slide base (14) and the water separation unit (12) are cooperated to form a mechanical pencil structure.

In another preferred embodiment, an automatically reposition function is disposed between the water separation unit (12) and the ball head component (10).

In another preferred embodiment, the water separation unit (12) comprises a housing (22) and an outlet (24) fixed inside the housing (22), the housing (22) is connected to the ball head component (10) in swinging way, the outlet (24) is disposed with several outlet waterways (28), the slide base (14) and the water separation disk (16) are assembled to the outlet (24), making that the outlet waterways (28) are switched when the water separation disk (16) rotates with respect to the outlet (24).

In another preferred embodiment, the swinging block (18) is a revolution body, the external revolution surface is a conical surface; a guiding base (34) is further disposed, the guiding base (34) is connected to the slide base (14) in freely rotating way, the guiding base (34) is disposed with a guiding hole, the internal revolution surface of the guiding hole is a conical surface; the swinging block (18) is cooperated to the guiding base (34), so that when sliding the swinging block (18) drives the guiding base (34) to slide and drives the slide base (14) to slide.

In another preferred embodiment, the ball head component (10) is disposed with a hollow shaft (46), a driving lever (20) with a ball shaped end is disposed below the shaft (46); the swinging block (18) is disposed with a truncated spherical groove (56), the end of the driving lever (20) is cooperated to the groove (56), so that when swinging with respect to the ball head component (10), the water separation unit (12) drives the swinging block (18) to slide with respect to the water separation unit (12).

In another preferred embodiment, a fixation base is fixed to the water separation unit (12), the fixation base comprises a fixation wall (30) and a periphery wall (32) extended downwards from the lower periphery of the fixation wall (30), the periphery wall (32) is fixed to the water separation unit (12), the fixation wall (30) is disposed with several arc shaped throughout grooves (36) and a water hole (38); the guiding base (34) is fixed with an arc shaped piece (40), which is coupled to the arc shaped throughout groove (36) and inserted into, the guiding base (34) is disposed on the fixation wall (30) in sliding way; the water separation disk (16) is disposed inside the periphery wall (32), the slide base (14) is connected to the arc shaped piece (40) in freely rotating way.

In another preferred embodiment, the swinging block (18) is disposed with a guiding hole inside, the internal revolution surface of the guiding hole is a conical surface; the slide base (14) is disposed with a coupling block (42), which is a revolution body and the external revolution surface is a conical surface; the swinging block (18) is cooperated to the coupling block (42), so that when sliding, the swinging block (18) drives the coupling block (42) to slide, and drives the slide base (14) to slide.

In another preferred embodiment, the ball head component (10) is disposed with a driving ring (44), the internal revolution surface of the driving ring (44) is contacted on the external revolution surface of the swinging block (18), so that when swinging, the driving ring (44) drives the swinging block (18) to slide.

In another preferred embodiment, the water separation unit (12) is hanging to the ball head component (10), the automatically reposition function of the water separation unit (12) is realized by the gravity itself.

In another preferred embodiment, a reposition component (26) is disposed between the shaft (46) and the housing (22).

Compared to the background technology, the technical proposal of the present invention has advantages as below:

1. Point touch the water separation unit to drive the water separation unit to swing with respect to the ball head component, to drive the swinging block to slide, to drive the slide base to slide to realize switch of waterways, the switching mechanism is a simple structure, is stable, works at a low voltage, and is convenient to operate;

2. The slide base is cooperated to the water separation unit to form mechanical pencil structure to cooperate with the swinging block to make it slide, the structure is simple and stable;

3. An automatically reposition function is disposed between the water separation unit and the ball head component, cooperated with the mechanical pencil structure, the switching mechanism is a simple and stable structure;

4. The swinging block is disposed with a conical surface, and the guiding base is disposed with a conical surface, with the cooperation of the conical surface of the swinging block and the conical surface of the guiding base, the sliding of the swinging block is linked to the sliding of the guiding base, so that it can be operated blindly, that is to say, switch is realized by point touching anywhere of the water separation unit (only if the water separation unit is swung), it is convenient to operate;

5. the swinging block is disposed with a conical surface, the slide base is disposed with a conical surface, with the cooperation of the conical surface of the swinging block and the conical surface of the slide base, the sliding of the swinging block is linked to the sliding of the slide base, so that it can be operated blindly, that is to say, switch is realized by point touching anywhere of the water separation unit (only if the water separation unit is swung), it is convenient to operate;

6. With the connection of the driving lever and the groove to change swinging to sliding, the structure is simple and stable;

7. With the connection of the driving ring and the swinging block to change swinging to sliding, the structure is simple and stable.

BRIEF DESCRIPTION OF THE DRAWINGS

The present invention will be further described with the drawings and the embodiment.

DETAILED DESCRIPTION OF THE EMBODIMENTS

Figure 1:
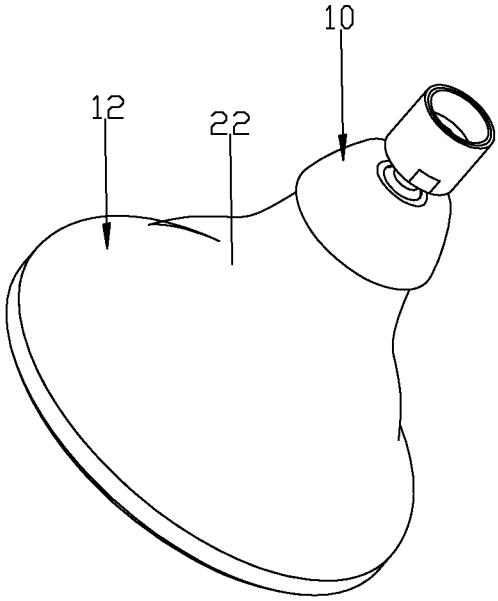
FIG. 1 illustrates the structure of the switching mechanism of the first preferred embodiment of the present invention.
Figure 2:
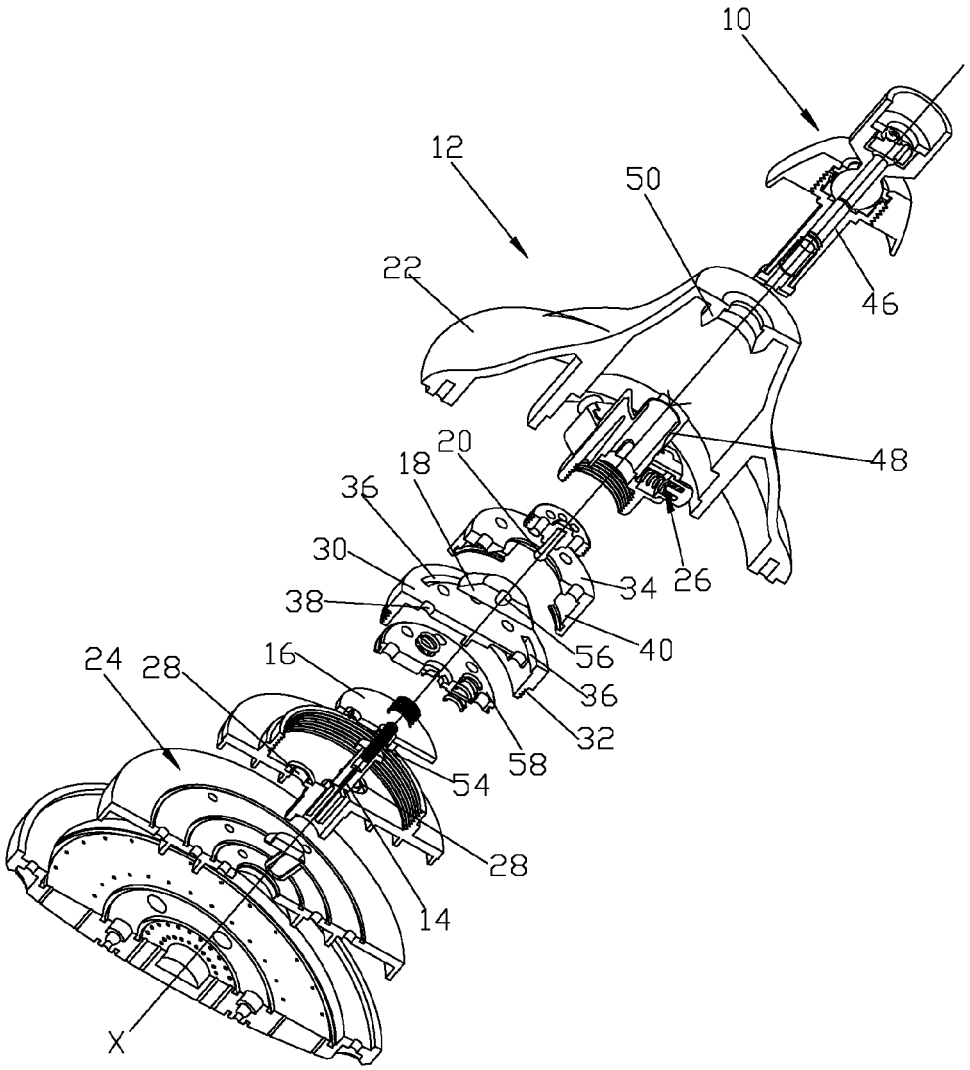
FIG. 2 illustrates the half sectional view of the switching mechanism of the first preferred embodiment of the present invention.

The first embodiment: please refer to FIG. 1 to FIG. 4. A point touch switching mechanism comprises a ball head component 10, a water separation unit 12, a switching unit and a swinging block 18.

The ball head component 10 is disposed with a hollow shaft 46, which is disposed with a connection base 48 outside, a driving lever 20 with a ball shaped end is disposed below the shaft 46.

The water separation unit 12 comprises a housing 22 and an outlet 24 fixed inside the housing 22. The housing 22 is horn shaped, the periphery of the upper end of the horn is extended inside to form an annular body, the inner periphery of the annular body is disposed with a support base 50. In this embodiment, the housing 22 is sleeved on the outside of the shaft 46, the support base 50 is supported the connection base 48, so that the housing 22 can swing around with respect to the ball head component 10. In this embodiment, an automatically reposition function is disposed between the water separation unit 12 and the ball head component 10. The water separation unit 12 is hanging to the ball head component 10, it is repositioned automatically by the gravity itself, as request, it is better to disposed with a reposition component 26 between the shaft 46 and the housing 22.

A fixation base is fixed inside the housing 22 on the outlet 24 in sealing way, the fixation base comprises a fixation wall 30 and a periphery wall 32 extended downwards from the lower periphery of the fixation wall 30. The periphery wall 32 is fixed inside the housing 22 in sealing way, the bottom of the periphery wall 32 is fixed on the outlet 24. The fixation wall is disposed with several arc shaped groove 36 and a water hole 38, the water hole is connected to the hollow hole of the shaft 46 to make the water entering into the fixation base through the hollow hole of the shaft 46 and the water hole 38. The outlet 24 is disposed with several outlet waterways 28, the water hole 38 and the inner cavity of the fixation base are cooperated to form part of the inlet waterway.

The switching unit comprises a slide base 14 and a water separation disk 16. The slide base 14 is connected to the outlet 24, so that the water separation disk 16 rotates forwards when it slides forwards or backwards with respect to the outlet 24 along the axis (X) of the water separation unit 12. the water separation disk 16 is fixed on the outside of the slide base 14, the switching of the outlet waterways 28 is realized by the relative rotation of the water separation disk 16 and the outlet 24.

In this embodiment, the water separation disk 16 is disposed inside the periphery wall 32 of the fixation base, a throughout hole is disposed in the water separation disk 16, the water inside the cavity of the fixation base enters into the outlet waterways 28 through the throughout hole to realize switching of outlet waterways 28. In this embodiment, a reposition device is disposed between the slide base 14 and the water separation unit 12. In this embodiment, the slide base 14, the water separation unit 12 and the reposition device are cooperated to form a mechanical pencil structure.

The swinging block 18 can slide on the fixation wall 30 of the water separation unit 12 along the plane vertical to the X. The swinging block 18 is disposed with a truncated spherical shaped groove 56, the end of the driving lever 20 is cooperate to the groove 56, so that when the water separation unit 12 is swung with respect to the ball head component 10, it drives the swinging block 24 to slide with respect to the water separation unit 12. In this embodiment, the swinging block 18 is a revolution body, and the external revolution surface is a conical surface with big end down.

The fixation wall 30 of the water separation unit 12 is connected with a guiding base 34 in sliding way, the guiding base 34 is disposed with a guiding hole, the internal revolution surface of the guiding hole is a conical surface. The swinging block 18 is cooperated to the guiding base 34, so that when the swinging block 18 slides, it drives the guiding base 34 to slide along the X line. An arc shaped piece 40 is fixed below the guiding base 34, the arc shaped piece 40 is coupled to the arc shaped throughout groove 36 and inserted into. In this embodiment, a coupling base 58 is hanging to the arc shaped piece 40 in freely rotating way, a second reposition spring 54 is disposed between the coupling base 58 and the slide base 14, so that the slide base 14 and the guiding base 34 is formed a connection relationship that they can rotate relatively and slide along the axis under the mutual action. In this embodiment, a first reposition spring 52 is disposed between the coupling base 58 and the fixation wall 30.

Figure 3:
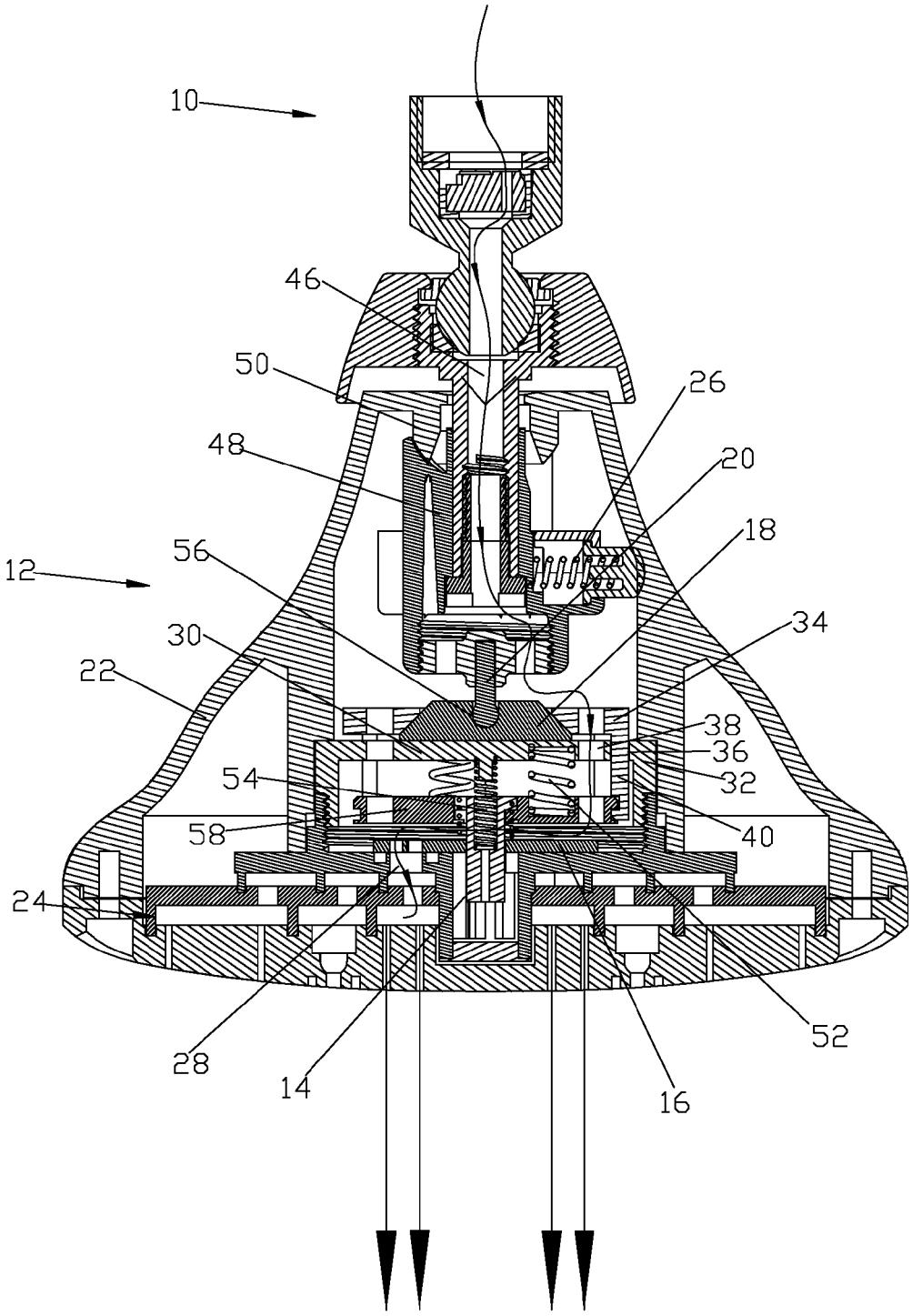
FIG. 3 illustrates the sectional view of the switching mechanism of the first preferred embodiment of the present invention, when the water separation unit is situated in the middle position.
Figure 4:
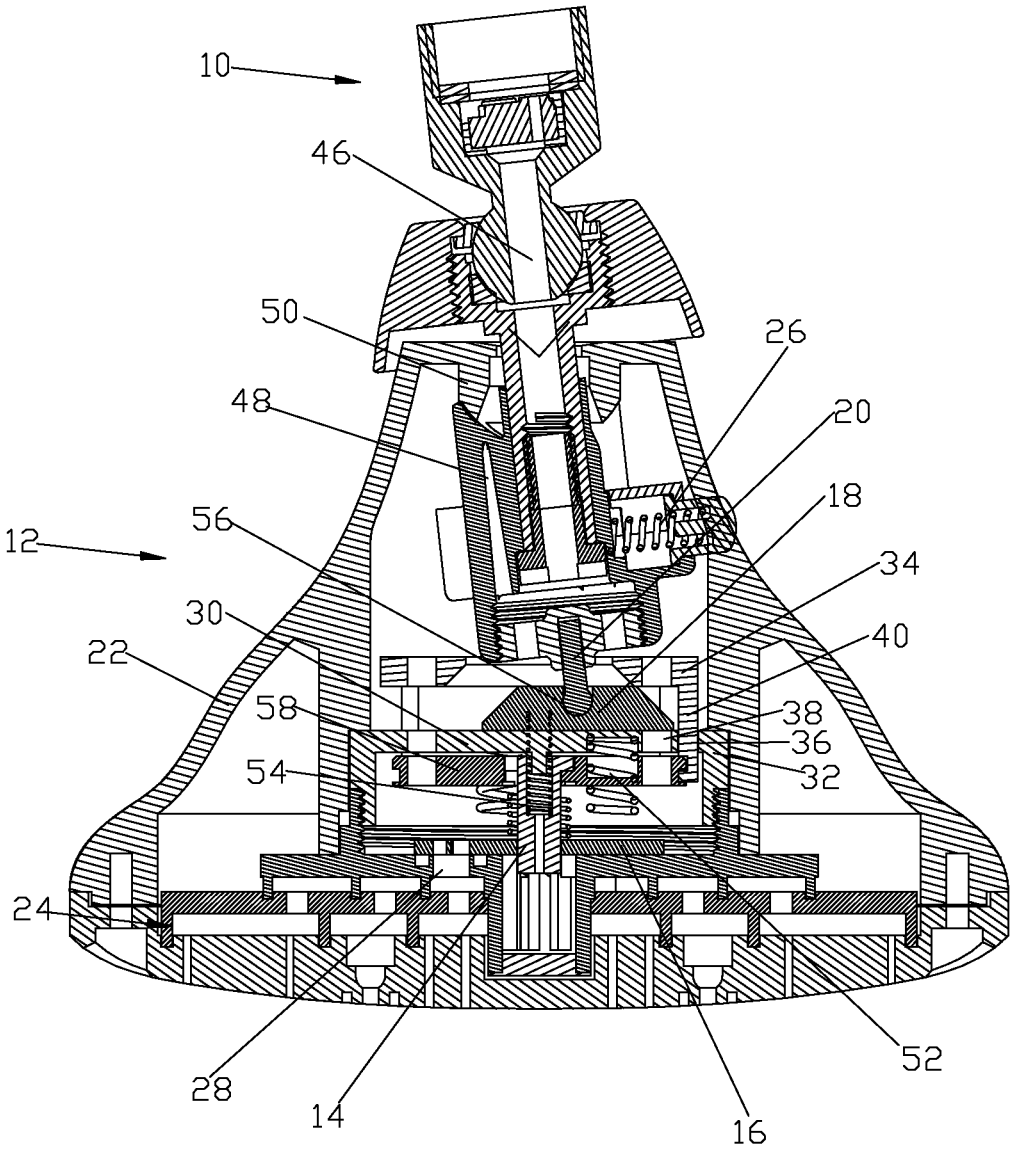
FIG. 4 illustrates the sectional view of the switching mechanism of the first preferred embodiment of the present invention, when the water separation unit is situated in the swinging position.

Please refer to FIG. 3 and FIG. 4: (1) the user point touches the outlet 24, making the water separation unit 12 swung with respect to the ball head component from the middle position to the swinging position, during swinging, the driving lever 20 is cooperated to the groove 56 of the swinging block 18 to make the swinging block 18 moved toward the first direction, the conical surface of the swinging block 18 is coupled to the conical surface of the guiding base 34 to make the guiding base 34 sliding upwards, the arc shaped piece 40 is cooperated to the slide base 14 to make the slide base 14 sliding upwards, during sliding, the slide base 14 rotates forwards an angle of ½ A, during sliding, the reposition springs 52 and 54 are compressed to store energy, the reposition component 26 stores energy; (2) when user releases his hold, under the work of the gravity and the released energy of the reposition component 26, the water separation unit 12 swings from the swinging position to the middle position to be repositioned, during swinging, the driving lever 20 is cooperated to the groove 56 of the swinging block 18 to make the swinging block repositioned to the primary position towards the second direction (opposite to the first position), the reposition springs 52 and 54 releases energy to make the guiding base 34 and the slide base 14 moving downwards to be repositioned to the primary position, during sliding, the slide base 14 rotates forwards an angle of ½ A; meanwhile, the water separation disk 16 rotates forwards an angle of A, making the throughout hole of the water separation disk 16 switched from the first outlet waterway to the second outlet waterway, realizing switch of waterways.

Figure 5:
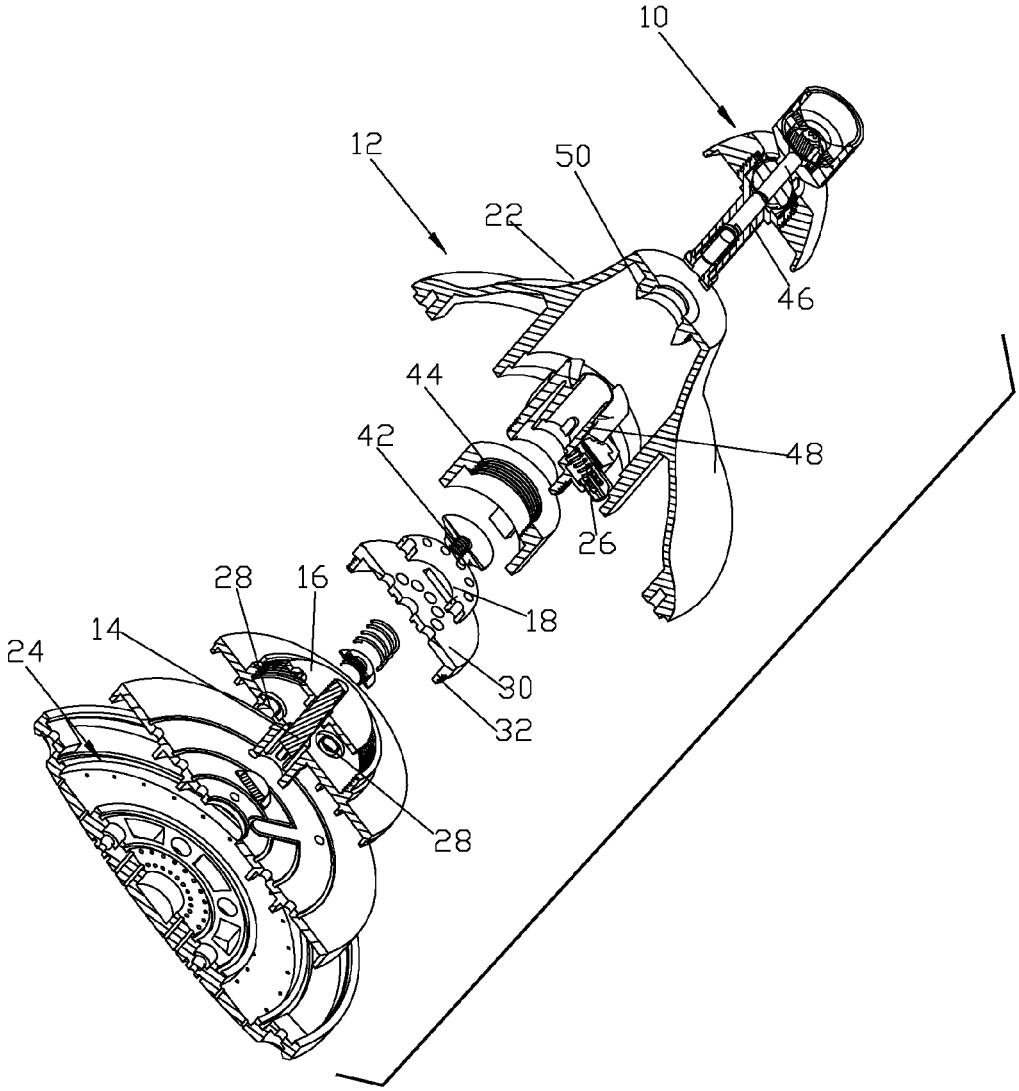
FIG. 5 illustrates the half sectional view of the switching mechanism of the second preferred embodiment of the present invention.
Figure 6:
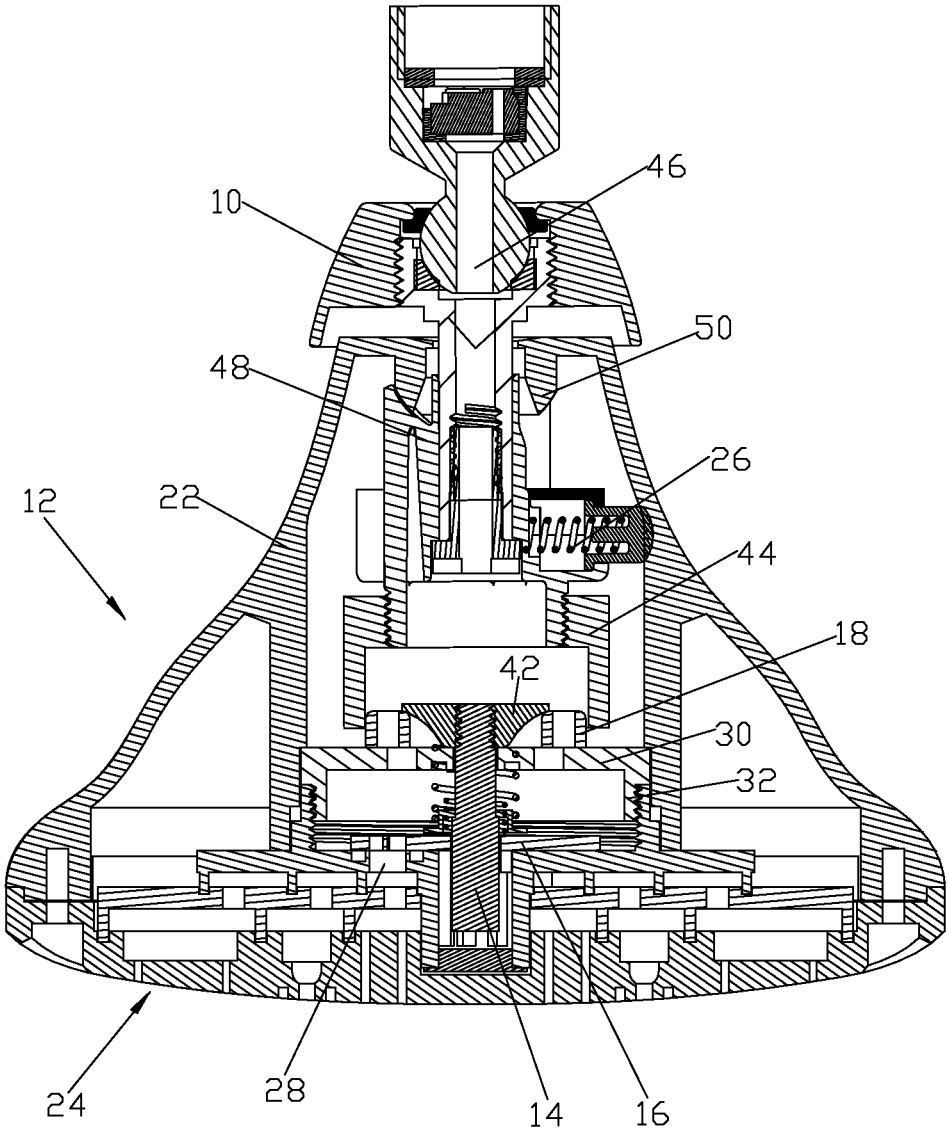
FIG. 6 illustrates the sectional view of the switching mechanism of the second preferred embodiment of the present invention, when the water separation unit is situated in the middle position.
Figure 7:
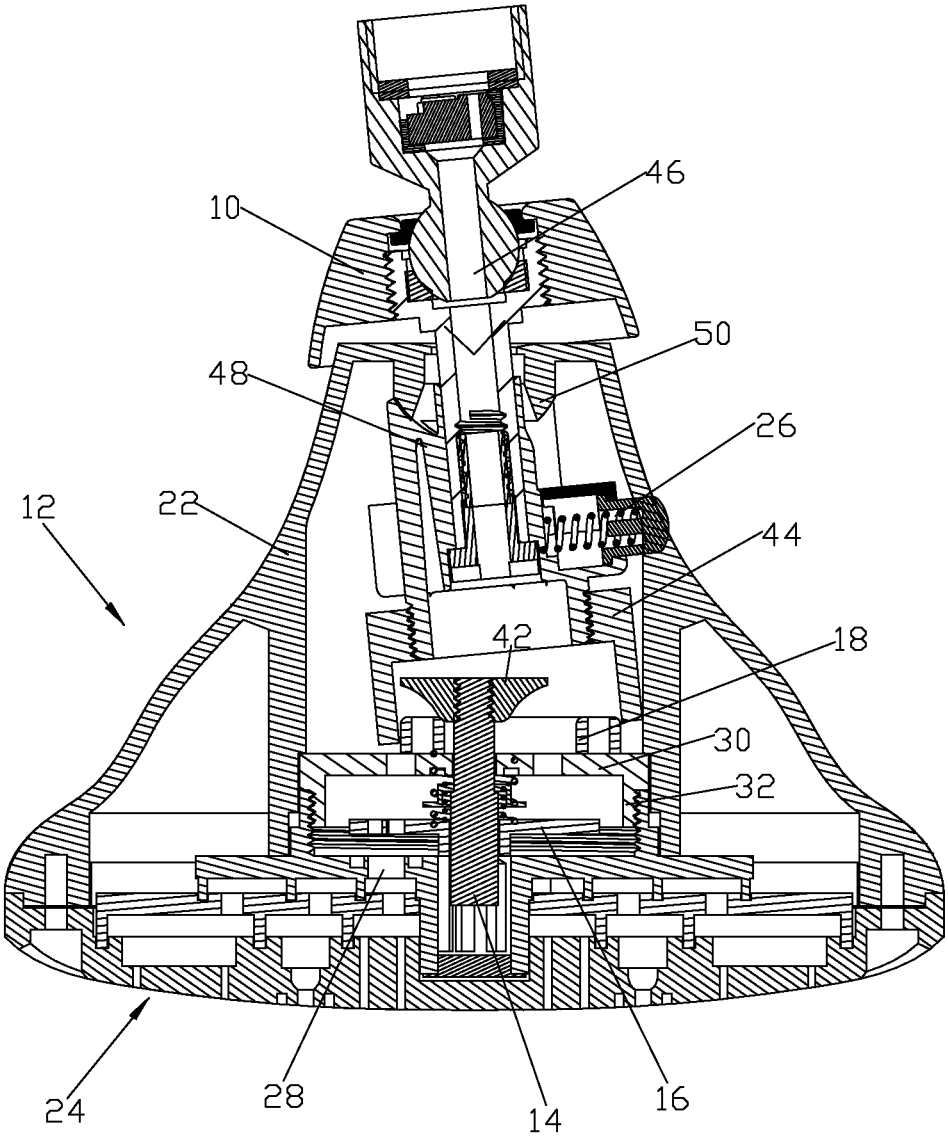
FIG. 7 illustrates the sectional view of the switching mechanism of the second preferred embodiment of the present invention, when the water separation unit is situated in the swinging position.

The second embodiment: please refer to FIG. 5 to FIG. 7, the difference from above embodiment is that: the water separation unit 12 is disposed with a driving ring 44, the internal revolution surface of the driving ring 44 is contacted on the external revolution surface of the swinging block 18, so that when swinging the driving ring 44 drives the swinging block 18 to slide. Preferred, the outer periphery of the swinging block 18 is smoothed. In this embodiment, it is provided without a guiding base, the structure hereafter is applied: the swinging block 18 is disposed with a guiding hole inside, the internal revolution surface of the guiding hole is a conical surface; the slide base 14 is fixed with a coupling block 42, the coupling block 42 is a revolution body, and the external revolution surface is a conical surface; the swinging block 18 is coupled to the coupling block 42, so that when the swinging block 18 slides, it drives the coupling block 42 to slide, then drives the slide base 14 to slide.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

INDUSTRIAL APPLICABILITY

The present invention is provided with a point touch switching mechanism, which comprises a ball head component (10), a water separation unit (12), a switching unit, and a swinging block (18). The water separation unit (12) can swing with respect to the ball head component (10). The switching unit comprises a slide base (14) connected to the water separation unit (12) and a water separation disk (16) fixedly connected to the slide base (14), so that the water separation disk (16) can rotate forward when sliding forward and backward with respect to the water separation unit (12), and water separation switching can be implemented when the water separation disk (16) rotates with respect to the water separation unit (12). The switching mechanism is a simple structure, is stable, works at a low voltage, and is convenient to operate.

What is claimed is:

1. A point touch switching mechanism, comprising:

a ball head component;

a water separation unit, which is connected to the ball head component, so that the water separation unit can swing with respect to the ball head component;

a switching unit, which comprises a slide base connected to the water separation unit and a water separation disk fixed to the slide base, so that the water separation disk rotates when sliding linearly with respect to the water separation unit, and water separation switching is implemented when the water separation disk rotates with respect to the water separation unit; and a swinging block, which is connected to slide linearly with respect to the water separation unit, wherein the sliding of the swinging block and the sliding of the slide base are linked, so that when swinging with respect to the ball head component, the water separation unit drives the swinging block to slide linearly with respect to the water separation unit and drives the slide base to slide linearly with respect to the water separation unit.

2. A point touch switching mechanism according to claim 1, wherein the swinging block slides relative to the water separation unit in a linear direction perpendicular to that in which the slide base slides relative to the water separation unit.

3. A point touch switching mechanism according to claim 2, wherein the slide base and the water separation unit cooperate to form a coaxial mechanical pencil structure.

4. A point touch switching mechanism according to claim 2, wherein an automatic repositioning component is disposed between the water separation unit and the ball head component.

5. A point touch switching mechanism according to claim 2, wherein the water separation unit comprises a housing and an outlet fixed inside the housing, the housing is connected to swing from the ball head component, the outlet is disposed with several outlet waterways, and the slide base and the water separation disk are assembled to the outlet, so that the outlet waterways are switched when the water separation disk rotates with respect to the outlet.

6. A point touch switching mechanism according to claim 1, wherein the swinging block is a revolution body, the external revolution surface is a conical surface; a guiding base is further provided, the guiding base is connected to the slide base to rotate freely thereto, the guiding base is provided with a guiding hole, the internal revolution surface of the guiding hole is a conical surface; and the swinging block cooperates with the guiding base, so that when sliding linearly the swinging block drives the guiding base to slide linearly and drives the slide base to slide linearly.

7. A point touch switching mechanism according to claim 6, wherein the ball head component is provided with a hollow shaft, a driving lever with a ball shaped end is disposed below the shaft; the swinging block is provided with a truncated spherical groove, and the end of the driving lever cooperates with the groove, so that when swinging with respect to the ball head component, the water separation unit drives the swinging block to slide with respect to the water separation unit.

8. A point touch switching mechanism according to claim 7, wherein a fixation base is fixed to the water separation unit, the fixation base comprises a fixation wall and a periphery wall extending downwards from the lower periphery of the fixation wall, the periphery wall is fixed to the water separation unit, the fixation wall is provided with several arc shaped throughput grooves and a water hole; the guiding base is fixed with an arc shaped piece, which is coupled to the arc shaped throughput groove and inserted thereinto, the guiding base is slidably disposed on the fixation wall; the water separation disk is disposed inside the periphery wall, and the slide base is connected to the arc shaped piece to freely rotate thereto.

9. A point touch switching mechanism according to claim 1, wherein the swinging block is disposed with a guiding hole inside, the internal revolution surface of the guiding hole is a conical surface; the slide base is provided with a coupling block, which is a revolution body and the external revolution surface is a conical surface; and the swinging block is cooperates with the coupling block, so that when sliding the swinging block drives the coupling block to slide, and drives the slide base to slide.

10. A point touch switching mechanism according to claim 9, wherein the ball head component is provided with a driving ring, and the internal revolution surface of the driving ring contacts the external revolution surface of the swinging block, so that when swinging, the driving ring drives the swinging block to slide.

11. A point touch switching mechanism according to claim 7, wherein the water separation unit is hanging on the ball head component, and the automatic repositioning function of the water separation unit is realized by gravity itself.

12. A point touch switching mechanism according to claim 11, wherein an automatic repositioning component is disposed between the shaft and the housing.

* * * * *